United States Patent [19]

Whatley

[11] 4,305,271

[45] Dec. 15, 1981

[54] APPARATUS FOR ROLLING CURVED SECTIONS

[75] Inventor: Osie B. Whatley, Florissant, Mo.

[73] Assignee: ACF Industries, Incorporated, New York, N.Y.

[21] Appl. No.: 104,508

[22] Filed: Dec. 17, 1979

[51] Int. Cl.[3] ..... B21D 7/02

[52] U.S. Cl. ..... 72/220; 72/57; 72/246; 72/379

[58] Field of Search ..... 72/54, 57, 220, 379, 72/226, 246

[56] References Cited

U.S. PATENT DOCUMENTS

| | | | |
|---|---|---|---|
| 557,922 | 4/1896 | Webster | 72/220 |
| 1,930,562 | 10/1933 | Krueger | 72/174 X |
| 2,036,745 | 4/1936 | Diehl | 72/220 |
| 2,662,573 | 12/1953 | Cichoskiet al. | 72/166 X |
| 2,775,152 | 12/1956 | Krause | 72/220 |
| 3,205,689 | 9/1965 | Joseph | 72/146 |
| 3,304,757 | 2/1967 | Achler et al. | 72/166 |
| 3,310,971 | 3/1967 | Motomatsu et al. | 72/226 X |
| 3,342,051 | 9/1967 | Leszak | 72/81 |
| 3,500,673 | 3/1970 | Wheeler et al. | 72/220 |

*Primary Examiner*—Leon Gilden

*Attorney, Agent, or Firm*—Henry W. Cummings

[57] ABSTRACT

A metal sheet is formed into an arcuate contour by rolling the sheet under high pressure on an elastomeric pad (24) supported by a rigid frame. A pair of laterally spaced rollers (30, 32) are used to form the arc. Each moves from the transverse edge of the sheet inwardly and crosses the center line of the sheet. Under the high pressure applied to the rolls the sheet yields to form the arc and the elastomeric material elastically deforms as the arc is formed. The rollers depend from vertical guides (34, 36) which follow a track extending transversely across the sheet. A guide track (38) is provided in a transverse beam located above the rolls and the guides. Hydraulic or pneumatic jacks (70) apply pressure to the beam which in turn applies pressure to the rolls.

12 Claims, 2 Drawing Figures

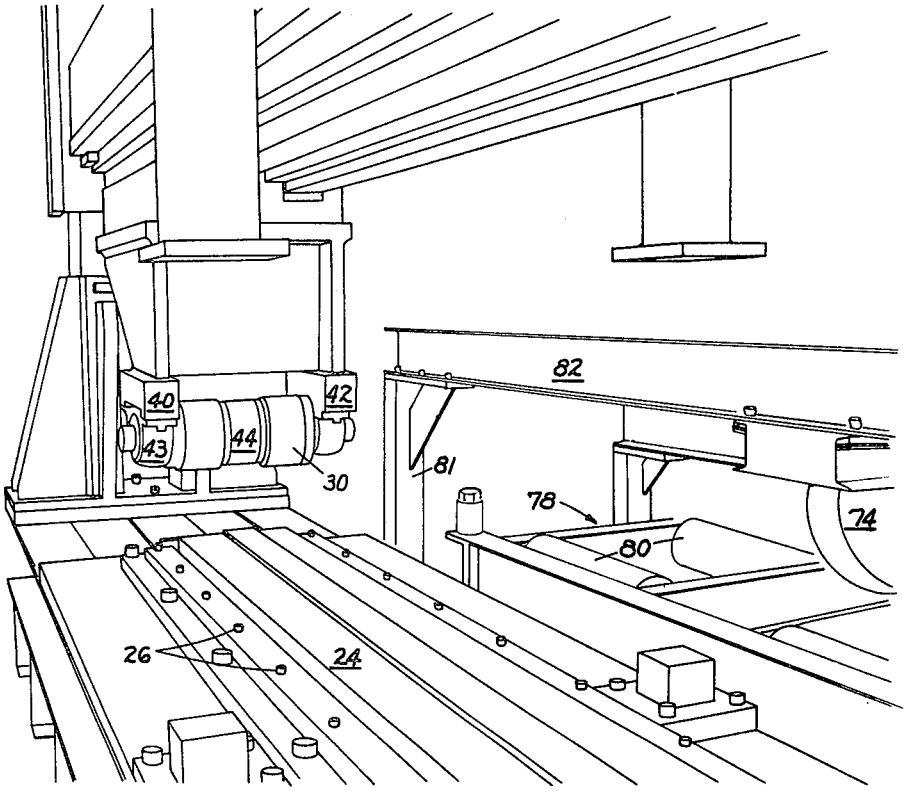
Fig. 2
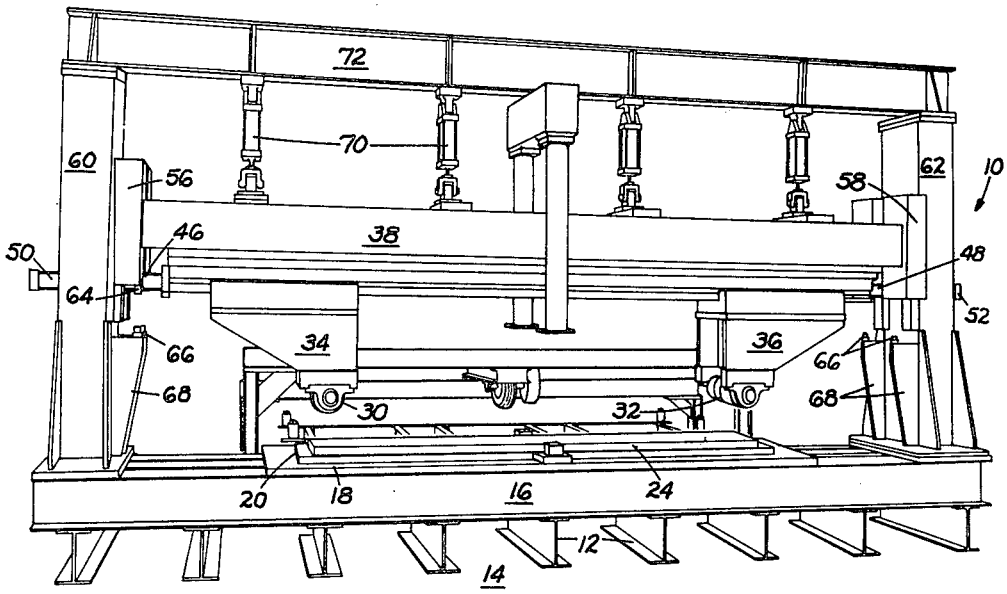

APPARATUS FOR ROLLING CURVED SECTIONS

BACKGROUND OF THE INVENTION

This invention relates to roll forming of metal shapes.

In U.S. Pat. No. 3,342,051 a curved shape is formed by movement of a roller upon a metal blank located upon a resilient pad in which the blank and the resilient pad rotate relative to the moving roller.

In U.S. Pat. No. 2,616,198 a blank located on a resilient base is deformed by a roller in which the blank and the resilient pad do not rotate.

It is also known to form a curved shape between a metallic roller and a resilient roller as illustrated by U.S. Pat. Nos. 1,930,562; 2,662,573; 3,205,689 and 3,304,757.

SUMMARY OF THE INVENTION

The object of the present invention is to provide an assembly for forming a curved section in a longitudinally extending sheet.

A metal sheet is formed into an arcuate contour by rolling the sheet under high pressure on an elastomeric pad supported by a rigid frame. At least one and preferably a pair of laterally spaced rollers are used to form the arc. Each roller moves from the transverse edge of the sheet inwardly and crosses the center line of the sheet. Under the high pressure applied to the rolls the sheet yields to form an arc in the sheet and the elastomeric material elastically deforms as the arc is formed.

The rollers are located on vertical guides which follow a track extending transversely across the sheet. A guide track is provided in a transverse beam located above the rolls and the guides. Hydraulic or pneumatic jacks apply pressure to the beam which in turn applies pressure to the rolls and sheet to form the arc.

THE DRAWINGS

FIG. 1 is a perspective view of the rolling assembly of the present invention.

FIG. 2 is a perspective view of the rolls to be utilized in the present invention.

DESCRIPTION OF PREFERRED EMBODIMENTS

The machine of the present invention is indicated in the drawings generally at 10.

A series of I beam supports 12 are located on the concrete floor 14 and support transverse I beams 16. Mounted upon the transverse I beams 16 is a steel plate 18. An elastomeric support plate 20 is located on steel plate 18. A layer or pad of elastomeric material 22 having a durometer value from 80 SHORE A to 95 SHORE A, for example, made of polyurethane, is then attached to plate 20 with fasteners 26. The elastomeric pad 24 has flanges which are clamped in place by the fasteners 26 as shown in FIG. 2.

A pair of rollers 30 and 32 are mounted upon guides 34 and 36 which depend from a transverse beam 38. Each of the rollers 30 and 32 is journaled in depending arms 40 and 42 (FIG. 2). Rolls 30 and 32 include a slot 44 to accommodate a corrugation in the sheet being formed. The diameter of rolls 30 and 32 is preferably within the range of four (4) inches to six (6) inches. In view of the high pressures utilized in the rolling of the present invention, heavy duty bearings 43 of a known construction are used to journal the rolls in the arms 40 and 42.

Guides 34 and 36 are each attached to respective pistons 46 and 48, each of which operates in a double acting fluid cylinder 50 and 52 to move the guide and rollers back and forth. Similarly, beam 38 is movable vertically within vertical guides 56 and 58 located on fixed vertical beams 60 and 62. A movable stop 64 is attached to each of guides 56 and 58. Fixed stops 66 supported by gussets 68 are used to locate the proper height of rolls 30 and 32 for rolling a sheet of metal located on elastomeric pad 24.

A series of hydraulic jacks 70 depend from a transverse beam 72 attached at opposite ends to fixed vertical beams 60 and 62. Hydraulic or pneumatic jacks 70 of up to fifteen (15) tons and higher are used to apply pressure to beam 38 and in turn to guides 34 and 36 and to rollers 30 and 32 when a sheet of metal is being formed. Rollers 30 and 32 move separately from the edge of the sheet inwardly towards the center portion. The rolls move at a range of ten (10) inches per minute to thirty (30) inches per minute.

A driven roller 74 (FIG. 2) is used to move sheets of material into position for rolling. A conveyor indicated generally at 78 is also provided for this purpose including a plurality of rolls 80. The conveyor and roller are mounted on conventional frame structure, including vertical beams 81 and transverse beams 82.

In the operation of the apparatus of the present invention conveyor 78 and roller 74 are utilized to move a sheet of material into position upon elastomeric pad 24 located between rollers 30 and 32. Jacks 70 are then utilized to lower beam 38 and apply pressure to guides 34 and 36 and rollers 30 and 32 to contact the material. Fluid is introduced into cylinder 50 to activate piston 46 and guide 34 to move roller 30 transversely across the work piece. In so doing the roller causes the sheet material to yield and the elastomeric material to elastically deform resulting in an arcuate shape being formed in the sheet. Roll 30 rolls to the center line of the sheet and is then retracted by reversing the flow of hydraulic fluid in cylinder 50. Fluid is then introduced into cylinder 52 activating piston 48 and causing roller 32 to move from right to left and form an arcuate contour on this portion of the sheet. Roller 32 rolls to the center line of the sheet and then is retracted by reversing the flow of fluid in cylinder 52. Sheets having an arcuate portion of seven (7) inches in diameter have been conveniently formed.

The slot 44 in rollers 30 and 32 is for the purpose of maintaining a reinforcing corrugation in the particular sheet being rolled. However, it is to be understood that slot 44 may be eliminated if such reinforcements are not provided in the sheet being rolled. The flow of fluid is controlled electronically in a known manner.

The preferred material for elastomeric pad 24 is polyurethane having a durometer value of 80 SHORE A to 95 SHORE A. An example of suitable polyurethane material is sold under the tradename Tool-A-Thane TM obtainable from Urethane Tool and Engineering Corporation. However, it is to be understood that other elastomeric materials such as polyethylene, polypropylene may be used for this pad provided they have the necessary durometer value and the strength to withstand the cycling of continuous or semi-continuous rolling of arcuate shapes.

What is claimed is

1. Apparatus for forming a metal sheet into an arcuate contour comprising: an elastomeric pad supported by a rigid frame; means for moving a metal sheet upon said pad; a pair of laterally spaced rollers located adjacent opposite edges of said pad; means for applying vertical pressure to said rolls; means for separately moving each of said rolls inwardly of the sheet; whereby under said pressure applied to the rolls, said sheet yields to form an arcuate shape and said elastomeric pad elastically deforms as the arc is formed.

2. Apparatus according to claim 1 including guide means to guide said rollers inwardly and across the center line of said sheet.

3. Apparatus according to claim 1 wherein said rollers depend from vertical guides which follow tracks extending transversely above the sheet.

4. Apparatus according to claim 3 wherein said guide tracks are provided in a transverse beam located above said rolls.

5. Apparatus according to claim 4 including means for applying pressure to said beam which in turn applies pressure to said rolls.

6. Apparatus according to claim 1 including means for controlling the speed of the rolls.

7. Apparatus according to claim 6 wherein the speed of the rolls is controlled by cylinder and piston mechanically connected to said rolls.

8. Apparatus according to claim 1 wherein said pad is made of polyurethane.

9. Apparatus for forming a metal sheet into an arcuate contour comprising: an elastomeric pad supported by a rigid frame; means for moving a metal sheet upon said pad; a pair of laterally spaced rollers located adjacent opposite edges of said pad; a transverse beam; roller guide views movable relative to said beam; means for applying vertical pressure to said beam; means for separately moving each of said rolls inwardly of the sheet along said roller guide means; whereby under said pressure applied to the rolls, said sheet yields to form an acruate shape and said elastomeric pad elastically deforms as the arc is formed; and means for moving said beam vertically to release said sheet.

10. Apparatus according to claim 9 including means for controlling the speed of the rolls.

11. Apparatus according to claim 10 wherein the speed of the rolls is controlled by cylinder and piston mechanically connected to said rolls.

12. Apparatus according to claim 9 wherein said pad is made of polyurethane.

* * * * *